US007242892B2

(12) United States Patent
Saito et al.

(10) Patent No.: US 7,242,892 B2
(45) Date of Patent: Jul. 10, 2007

(54) WET TYPE IMAGE FORMING APPARATUS

(75) Inventors: Hiroyuki Saito, Tokyo (JP); Hidetaka Yamaguchi, Tokyo (JP); Motohiro Maseki, Saitama-ken (JP)

(73) Assignee: PENTAX Corporation, Tokyo (JP)

( * ) Notice: Subject to any disclaimer, the term of this patent is extended or adjusted under 35 U.S.C. 154(b) by 110 days.

(21) Appl. No.: 11/137,552

(22) Filed: May 26, 2005

(65) Prior Publication Data

US 2005/0271422 A1 Dec. 8, 2005

(30) Foreign Application Priority Data

Jun. 7, 2004 (JP) ..... 2004-167976

(51) Int. Cl.
*G03G 15/10* (2006.01)

(52) U.S. Cl. ..... 399/237; 399/239; 399/240

(58) Field of Classification Search ..... 399/237, 399/240, 239

See application file for complete search history.

(56) References Cited

U.S. PATENT DOCUMENTS

| | | | | |
|---|---|---|---|---|
| 6,571,075 | B2 * | 5/2003 | Nakashima et al. | 399/237 |
| 6,640,073 | B2 | 10/2003 | Kurotori et al. | |
| 6,842,599 | B2 * | 1/2005 | Shibata et al. | 399/237 |
| 6,907,213 | B2 * | 6/2005 | Fordahl et al. | 399/237 |
| 2002/0098016 | A1 | 7/2002 | Kurotori et al. | |
| 2004/0005174 | A1 | 1/2004 | Park et al. | |

FOREIGN PATENT DOCUMENTS

| | | |
|---|---|---|
| JP | 5-046053 | 2/1993 |
| JP | 5-158354 | 6/1993 |
| JP | 5-273867 | 10/1993 |
| JP | 6-149073 | 5/1994 |
| JP | 7-181811 | 7/1995 |
| JP | 2562424 | 9/1996 |
| JP | 9-218585 | 8/1997 |
| JP | 2000-250318 | 9/2000 |
| JP | 2001-034073 | 2/2001 |

(Continued)

OTHER PUBLICATIONS

English Language Abstract of JP 2000-250318.

(Continued)

*Primary Examiner*—David M. Gray
*Assistant Examiner*—David A Blackshire
(74) *Attorney, Agent, or Firm*—Greenblum & Bernstein, P.L.C.

(57) ABSTRACT

A wet type image forming apparatus forms an image in accordance with an electrophotographic imaging process using a developing solution containing a toner in a carrier solution. The image forming apparatus includes a developing roller that holds the developing solution thereon, the developing roller being electrically charged to attract a toner contained in the developing solution toward its surface, a photoconductive drum on which a latent image to be developed is formed, the photoconductive roller being arranged to contact the developing roller, a scraping blade disposed in contact with the developing roller, the scraping blade scraping off the developing solution that has not been consumed for developing from the surface of the developing roller, and a toner separator that separates the toner that has not been consumed for developing from the surface of the developing solution carrier before the developing solution is scraped off by the scraping blade.

4 Claims, 3 Drawing Sheets

FOREIGN PATENT DOCUMENTS

| | | |
|---|---|---|
| JP | 2002-214920 | 7/2002 |
| JP | 2002-278300 | 9/2002 |
| JP | 2004-038172 | 2/2004 |

OTHER PUBLICATIONS

English Language Abstract of JP 2001-034073.
English Language Abstract of JP 2002-214920.
English Language Abstract of JP 2002-278300.
English Language Abstract of JP 2004-038172.
English Language Abstract of JP 5-158354.
English Language Abstract of JP 5-273867.
English Language Abstract of JP 5-046053.
English Language Abstract of JP 6-149073.
English Language Abstract of JP 7-181811.
U.S. Appl. No. 11/137,576 to Yamaguchi et al., filed May 26, 2005.
U.S. Appl. No. 11/150,124 to Maseki et al., filed Jun. 13, 2005.

* cited by examiner

WET TYPE IMAGE FORMING APPARATUS

BACKGROUND OF THE INVENTION

The present invention relates to a wet type image forming apparatus that forms an image with a developing solution containing a toner in a carrier solution.

Apparatuses that transfer a toner to a recording paper to thereby form an image include, for example, a dry type image forming apparatus, which applies a powder toner to a surface of a developing roller (also called a "developer carrier") to form an image, and a wet type image forming apparatus, which applies a developing solution containing a toner in a carrier solution to a surface of a developing roller to form an image, as disclosed in Japanese Patent Provisional Publication No. P2002-214920A. The toner employed in the latter apparatus is finer than that employed in the former. Accordingly, the latter provides an image of a higher quality.

In the wet type image forming apparatus according to the above publication, a cleaning blade disposed in contact with the surface of a developing roller scrapes off the developing solution that has not been consumed for a developing process on a photoconductive drum. However, the toner contained in the developing solution is very fine, and can stick to the surface of the developing roller. Therefore, a portion of the toner may pass through the thin gap between the developing roller surface and the cleaning blade, or be deposited in a region close to the cleaning blade. The toner that passes through the gap is especially problematic, since such toner is unevenly deposited in grooves on an anilox roller, thereby creating an uneven developing result.

SUMMARY OF THE INVENTION

The present invention is advantageous in that an improved wet type image forming apparatus is configured such that the unconsumed toner can be thoroughly scraped off with a cleaning blade.

According to aspects of the invention, there is provided a wet type image forming apparatus the forms an image in accordance with an electrophotographic imaging process using a developing solution containing a toner in a carrier solution. The image forming apparatus includes a developing roller that holds the developing solution thereon, the developing roller being electrically charged to attract a toner contained in the developing solution toward its surface, a photoconductive drum on which a latent image to be developed is formed, the photoconductive drum being arranged to contact the developing roller, a scraping blade disposed in contact with the developing roller, the scraping blade scraping off the developing solution that has not been consumed for developing from the surface of the developing roller, and a toner separator that separates the toner that has not been consumed for developing from the surface of the developing solution carrier before the developing solution is scraped off by the scraping blade.

Optionally, the toner separator separates the toner from the surface of the developing solution carrier utilizing an effect of electrophoresis.

Further, the toner separator may generate an electric field so as to separate the toner in the developing solution from the surface of the developing solution carrier.

Further optionally, the toner separator may include a conductive member, one end of the conductive member being electrically connected to the developing roller and another end of the conductive member being electrically connected to a potential that is lower than the potential of the developing solution carrier in a charged state.

BRIEF DESCRIPTION OF THE ACCOMPANYING DRAWINGS

DETAILED DESCRIPTION OF THE EMBODIMENTS

Overview

According to an aspect of the present invention, a wet type image forming apparatus forms an image in accordance with an electrophotographic imaging process using a developing solution containing a toner in a carrier solution. The image forming apparatus includes a developing roller that holds the developing solution thereon, the developing roller being electrically charged to attract a toner contained in the developing solution toward its surface, a photoconductive drum on which a latent image to be developed is formed, the photoconductive drum being arranged to contact the developing roller, a scraping blade disposed in contact with the developing roller, the scraping blade scraping off the developing solution that has not been consumed for developing from the surface of the developing roller, and a toner separator that separates the toner that has not been consumed for developing from the surface of the developing solution carrier before the developing solution is scraped off by the scraping blade.

In the wet type image forming apparatus thus constructed, the toner is separated from the surface of the developing solution carrier before the developing solution is scraped off from the photoconductive drum. This inhibits the toner from being deposited in a region close to the scraping blade or passing through a thin gap between the roller surface and the blade, and therefore the toner can be effectively removed from the roller surface. Consequently, the toner is no longer deposited in the grooves of the anilox roller thus to create an uneven developing result, and a high-quality image can be printed on a recording paper.

Embodiment

Referring to the accompanying drawings, a wet type printer according to an embodiment of the present invention will be described in detail.

Figure 1:
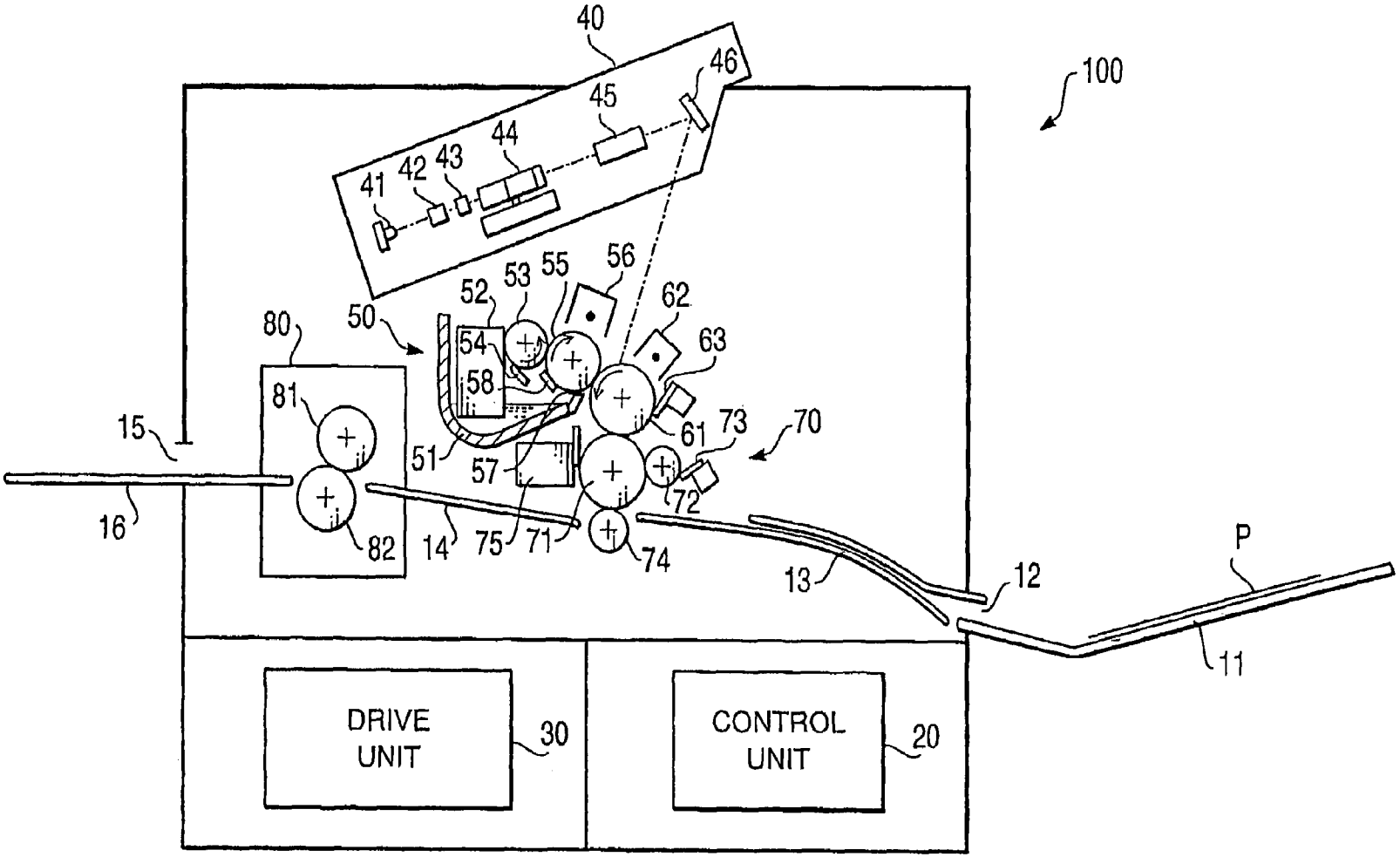
FIG. 1 is a cross-sectional side view of a wet type printer according to an embodiment of the present invention.

FIG. 1 is a cross-sectional side view showing a structure of a wet type printer 100 according to an embodiment of the present invention. The wet type printer 100 is an apparatus that forms an image with a developing roller that carries, on its surface, a developing solution containing a toner in a carrier solution, and more specifically an apparatus that receives print information (i.e., character and/or image information) from an external apparatus such as a computer, and prints out the letter or image on a recording paper P in accordance with a so-called electrophotographic imaging process.

The wet type printer 100 generally includes a control unit 20 that controls a printing process, sheet feeding operation and so on, a driving unit 30 that drives various mechanisms, a laser scanning unit (hereinafter, abbreviated as "LSU") 40 that outputs a laser beam modulated according to print information, a developing unit 50 that develops a latent image formed according to print information with a developing solution, a transfer unit 70 that transfers a toner image developed by the developing unit 50 at a transfer position onto the recording paper P, a feeding mechanism that feeds the recording paper P, and a fixing unit 80 that permanently fixes the toner image which has been transferred on the recording paper P.

The driving unit 30 serving as a driving source of the mechanisms in the wet type printer 100 includes a plurality of actuators that drive the respective mechanisms. All of these actuators are connected to the control unit 20, to be driven under the control of the control unit 20. The driving unit 30 can cause a rotation of, for example, a developing roller 55 and photoconductive drum 61 included in the developing unit 50, and a heat roller 81 included in the fixing unit 80.

On a side face of a housing of the wet type printer 100, a paper inlet 12 is formed, through which the recording paper P is introduced into the printer 100, and a paper tray 11 for storing the recording paper P is attached at the paper inlet 12. On the opposite side face of the housing, a paper outlet 15 and a receiver tray 16 are provided. The recording paper P, upon being introduced into the wet type printer 100 through the paper inlet 12, is fed along a paper path 13 to reach the transfer position defined by the transfer unit 70, where the toner image is transferred onto the surface of the recording paper P. Thereafter the recording paper P is fed along a paper path 14 to reach a fixing position defined by the fixing unit 80 for fixation of the toner image. Then, the recording paper P is discharged from the wet type printer 100 through the paper outlet 15.

The toner image corresponding to the print information to be transferred to the recording paper P at the transfer unit 70 is initially generated by the control unit 20 and the LSU 40. The LSU 40 includes a laser diode 41 serving as a light source, a collimating lens 42, a cylindrical lens 43, a polygon mirror 44, an imaging lens 45 and a deflecting mirror 46. Instead of the LSU 40, an LED (Light Emitting Diode) and a reducing optical system may be employed as the exposure method.

The laser diode 41 is driven under the control of the control unit 20. That is, the laser diode 41 is turned on and off (i.e. modulated) according to the print information, thereby emitting a laser beam modulated carrying the image information. The laser beam irradiated by the laser diode 41 enters the collimating lens 42, which converts the laser beam from a diffused luminous flux into a parallel luminous flux.

The laser beam converted into a parallel luminous flux (i.e., collimated) is converged by the cylindrical lens 43 solely in a sub-scanning direction so that the laser beam is converged on a plane, in the sub-scanning direction, close to a reflecting surface of the polygon mirror 44. It is to be noted that the sub-scanning direction herein referred to designates a direction parallel to a plane of FIG. 1 (a direction orthogonal to the rotating shaft of the photoconductive drum 61, i.e. a tangent on a circumferential surface thereof), while a direction orthogonal to the sub-scanning direction, i.e. a direction in which the laser beam is scanned on the photoconductive drum 61 (an axial direction on the photoconductive drum 61) is herein defined as a main scanning direction.

The polygon mirror 44 is rotated by a motor (not shown), and hence the laser beam linearly converged (converged only in a sub-scanning direction) by the cylindrical lens 43 substantially at a section of the reflecting surface of the polygon mirror 44 is deflected so as to be scanned in a main scanning direction, and enters the imaging lens 45. The laser beam passed through the image forming lens 45 scans in a main scanning direction at a predetermined speed on the photoconductive drum 61. The laser beam thus converted is deflected by the deflecting mirror 46 toward the photoconductive drum 61, to thereby form an image on the photoconductive drum 61. At this stage, since the laser beam is modulated with the progress of the main scanning, a scanning line according to the print information is formed on the photoconductive drum 61. Also, since the photoconductive drum 61 rotates in a sub-scanning direction, a plurality of scanning lines are formed in a sub-scanning direction on the photoconductive drum 61. As a result, a two-dimensional latent image corresponding to the print information is formed on the photoconductive drum 61. It should be noted that the reflecting surface of the polygon mirror 44 and the photoconductive drum 61 have a conjugate relationship with respect to the sub-scanning direction. Accordingly, the scanning line spacing is not shifted in a sub-scanning direction, even when the polygon mirror 44 incurs a facet error.

The developing unit 50 includes a developing solution tank 51 in which the developing solution is stored, a pump unit 52 that aspirates the developing solution out of the developing solution tank 51, a measuring roller 53 to which the aspirated developing solution is supplied, an adjusting blade 54 that adjusts an amount of the developing solution supplied to the measuring roller 53, a developing roller 55 that carries the adjusted developing solution, a developing roller charger (hereinafter, referred to as a corona charger) 56 that charges the developing roller 55, and a developing roller cleaning blade 58 that scrapes off the developing solution from the surface of the developing roller 55, for removal. On the surface of the photoconductive drum 61, a latent image is formed by the LSU 40 based on the print information. A photoconductive drum charger (Hereinafter, referred to as a corona charger) 62 charges the photoconductive drum 61 for adhering the toner according to the latent image onto the surface of the photoconductive drum 61. The photoconductive drum 61 and the corona charger 62 are located close to the developing unit 50. A photoconductive drum cleaning blade 63 is located close to the developing unit 50, for scraping off the toner remaining on the surface of the photoconductive drum 61 without being transferred to an intermediate transfer roll 71, to be later described, included in the transfer unit 70.

Next, a flow of the developing solution inside the developing unit 50 as well as a developing process performed therein will be described.

The developing solution stored in the developing solution tank 51 is agitated by an agitating mechanism (not shown), so that a concentration of the toner is maintained substantially uniform in the developing solution. The developing solution is aspirated by the pump unit 52 constituted of a known pumping mechanism, to be supplied to the measuring roller 53.

A portion of the developing solution supplied to the measuring roller 53 by the pump unit 52 is scraped off (i.e. adjusted) by the adjusting blade 54. Here, the measuring roller 53 is provided with a plurality of linear grooves formed at every predetermined interval on its surface, and set to rotate counterclockwise in FIG. 1. Accordingly, the remaining portion of the developing solution supplied to the measuring roller 53, which is retained in the grooves, is exempted from being scraped off. Therefore, it is only the portion retained in the grooves, i.e. the accurately measured portion of the developing solution, that remains on the surface of the measuring roller 53. Such configuration enables achieving uniform application of the developing solution to the developing roller 55, which rotates in contact with the measuring roller 53.

Figure 2:
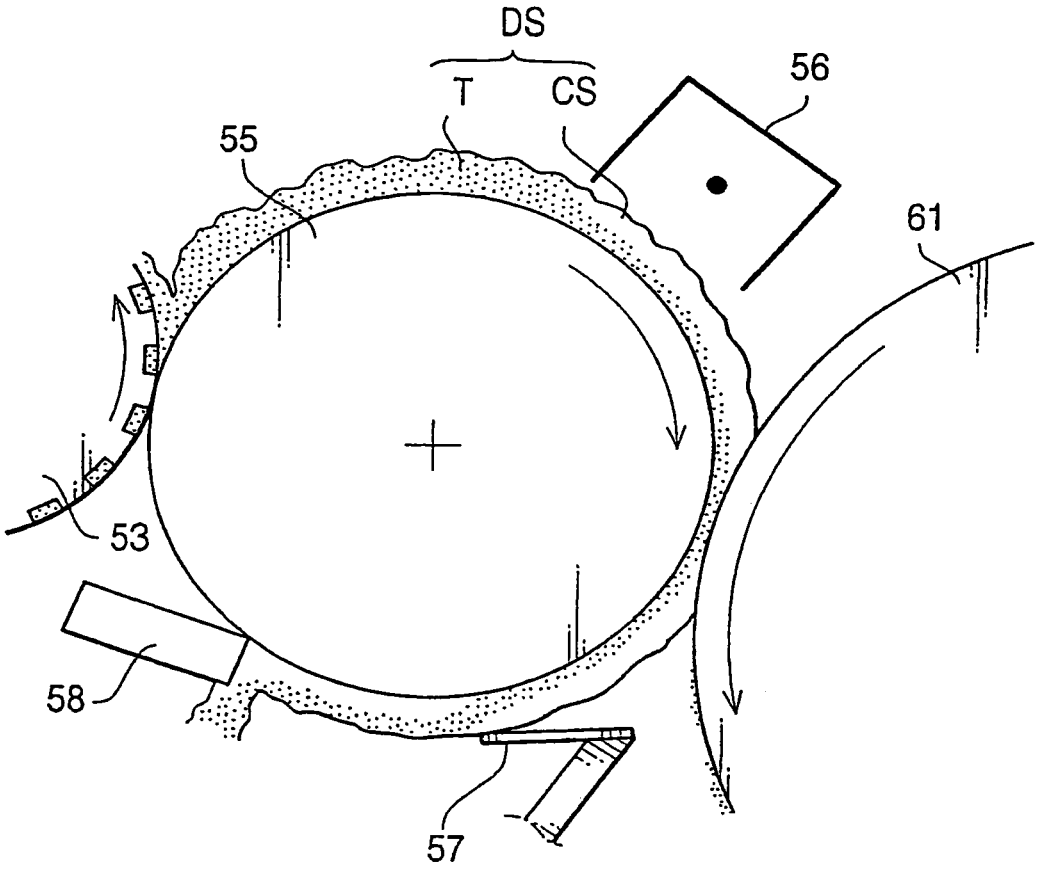
FIG. 2 is an enlarged cross-sectional view showing a section around a developing roller of the wet type printer shown in FIG. 1.

FIG. 2 is an enlarged cross-sectional side view showing a section around the developing roller 55 according to the embodiment. In FIG. 2, the symbol DS denotes the developing solution being carried by the respective rollers, CS denotes the carrier solution of DS and T denotes the toner (illustrated as black dots in the solution) contained in CS.

The developing solution contains the toner T in a uniform concentration, immediately after the application to the developing roller 55 from the measuring roller 53. Accordingly, as shown in FIG. 2, the toner T is uniformly distributed in the carrier solution CS, in a region close to the interface between the measuring roller 53 and the developing roller 55. The developing roller 55 rotates in the clockwise direction in FIGS. 1 and 2. Therefore, the developing solution DS having a uniform concentration is carried by the surface of the developing roller 55, to thereby pass under the corona charger 56 for the developing roller 55.

The developing roller 55 has a surface constituted of a conductive material, so that such surface is uniformly charged by a corona charging effect of the corona charger 56 for the developing roller 55. The charging effect generates an electric field between the surfaces of the developing roller 55 and the developing solution DS, which causes the toner T uniformly distributed in the carrier solution CS, to move toward the surface of the developing roller 55. In other words, the developing solution DS is split into two layers, namely, a layer containing only the carrier solution CS and the other layer containing the toner T in a higher concentration than the initial state in the carrier solution CS. The latter layer contacts the surface of the developing roller 55.

The developing solution DS split into two layers then reaches the position to contact the photoconductive drum 61. On the surface of the photoconductive drum 61, the latent image based on the printing information is formed as exposed to the modulated and scanning laser beam from the LSU 40. The photoconductive drum 61 is charged so as to gain a higher potential than the developing roller 55, by the corona charger 62 for the photoconductive drum 61. However, the region where the latent image is formed gains a lower potential than the developing roller 55. Accordingly, between the region on the photoconductive drum 61 excluding the latent image and the surface of the developing roller 55, the toner T is attracted to the lower-potential region, i.e. the surface of the developing roller 55. Therefore, the toner is not transferred to the photoconductive drum 61 at the region where the latent image is not provided. That is, the region excluding the latent image is not developed. On the other hand, between the photoconductive drum 61 at the region where the latent image is formed and the surface of the developing roller 55, the toner T performs electrophoresis toward the lower-potential region, i.e. the surface of the photoconductive drum 61 at the region where the latent image is formed, thus to adhere thereto. That is how the latent image on the photoconductive drum 61 is developed, to turn into a toner image.

The developing solution DS containing the toner T that has not been consumed for developing then passes by a conductive sheet 57. The conductive sheet 57 is, for example, a thin metal sheet made of SUS or a polyethylene terephthalate (PET) film having conductivity, and an end thereof is connected to the developing roller 55 and another end is connected to a potential lower than that of the charged developing roller 55.

Figure 3:
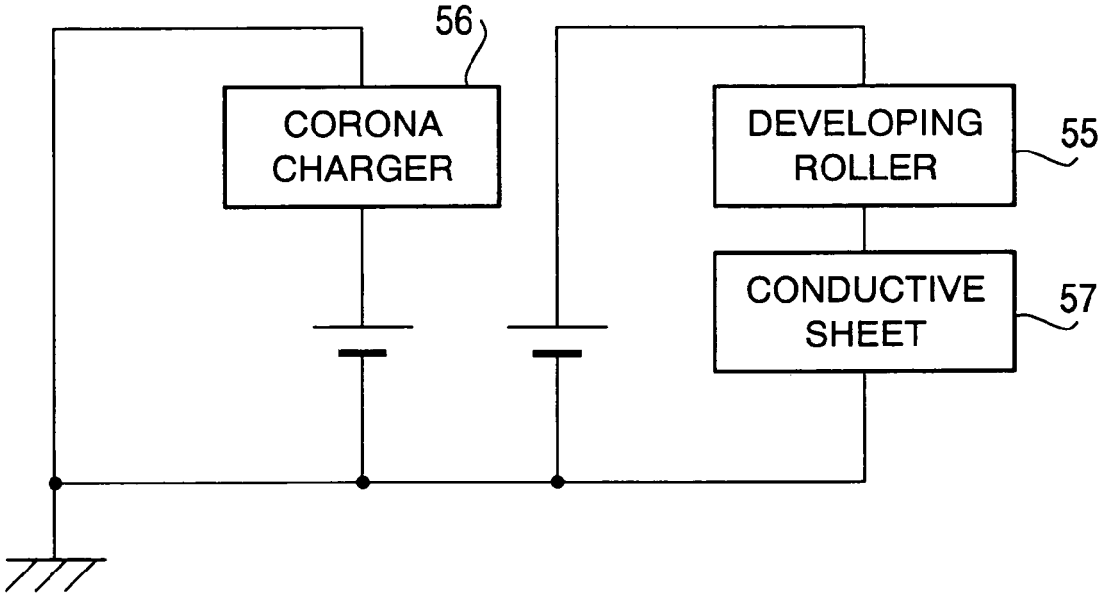
FIG. 3 is a block diagram illustrating a potential relationship among a charger for developing roller, a developing roller and a conductive sheet of the wet type printer of FIG. 1.

FIG. 3 is a block diagram illustrating a potential layout in the section around a developing roller 55. In this embodiment, an end of the conductive sheet 57 is connected to the developing roller 55 (for example 400V), and another end is connected to the ground. Therefore, the toner T passing by the conductive sheet 57 performs electrophoresis toward the lower-potential region, i.e. the conductive sheet 57, from the surface of the developing roller 55. Consequently, the layer of the developing solution DS on the side of the surface of the developing roller 55 only contains the carrier solution CS, while the other layer, i.e. the layer farther from the conductive sheet 57 acquires a higher concentration of the toner T in the carrier solution CS.

The toner T, upon passing by the conductive sheet 57, is scraped off by the developing roller cleaning blade 58 disposed in contact with the developing roller 55, thus to be removed from the surface thereof. Meanwhile, the toner T located in a region excluding the latent image is attracted toward the surface of the developing roller 55 thus to be more closely attracted thereto, by a developing bias applied in the nipped region and an electric field generated by the potential of the latent image portion on the photoconductive drum 61. In the case where the toner T in such a state is carried toward the cleaning blade 58, the toner T may be deposited in a region close to the developing roller cleaning blade 58, or pass through the thin gap between the roller surface and the blade. However, the foregoing effect of the conductive sheet 57 separates the toner T from the surface of the developing roller 55, thus inhibiting the toner T from being deposited in a region close to the developing roller cleaning blade 58 or passing through the thin gap between the roller surface and the blade 58. Consequently, the toner T can be substantially thoroughly scraped off by the developing roller cleaning blade 58. The developing solution DS scraped off at this stage is collected in the developing solution tank 51.

The toner image developed on the surface of the photoconductive drum 61 is transferred to the recording paper P by the transfer unit 70. The transfer unit 70 includes an intermediate transfer roll 71, a carrier solution squeeze roll 72, a carrier solution cleaning blade 73, a secondary transfer roll 74, and an intermediate transfer roll cleaning unit 75.

To the intermediate transfer roll 71, a transfer bias of a reverse polarity to the toner T is applied, so that the toner image developed on the surface of the photoconductive drum 61 is transferred as a primary step to the intermediate transfer roll 71, at the interface between the photoconductive drum 61 and the intermediate transfer roll 71. At this stage, the portion of the toner remaining on the surface of the photoconductive drum 61 without being transferred at the interface is scraped off from the surface of the photoconductive drum 61, by the photoconductive drum cleaning blade 63. Also, the carrier solution CS that has adhered to the surface of the intermediate transfer roll 71 together with the toner image is removed from the surface by the carrier solution squeeze roll 72. Such residual carrier solution CS is then removed from the surface of the carrier solution squeeze roll 72 by the carrier solution cleaning blade 73, and collected in a waste toner box (not shown), to be disposed of as a waste toner.

The intermediate transfer roll 71 and the secondary transfer roll 74 are disposed so as to oppose each other with the paper path for the recording paper P being located therebetween, and mutually abutted at a predetermined nip pressure. The toner image transferred to the surface of the intermediate transfer roll 71 is transferred to the recording paper P which is fed along the paper path at the interface with the secondary transfer roll 74, by the effect of a transfer electric field, the nip pressure and so on. The intermediate transfer roll 71, interposed between the secondary transfer roll 74 and the photoconductive drum 61, also serves to prevent the nip pressure of the secondary transfer roll 74 from being directly applied to the photoconductive drum 61. Further, the toner T that remains on the surface of the intermediate transfer roll 71 after the transference to the recording paper P is removed by the intermediate transfer roll cleaning unit 75, and collected in a waste toner box (not shown), to be disposed of as a waste toner.

The recording paper P on which the toner image has been transferred is fed to the fixing unit 80 along the paper path 14. The fixing unit 80 serves to apply heat and pressure to the recording paper P, so as to fix the toner image (i.e. the printing information) onto the recording paper P. The fixing unit 80 includes a heat roller 81 that heats up the recording paper P, and a press roller 82 opposing the heat roller 81 across the paper path, so as to hold the recording paper P in cooperation with the heat roller 81, thus to apply a predetermined pressure to the recording paper P. The recording paper P is then discharged through the paper outlet 15.

Although the present invention has been described based on the foregoing embodiment, it should be understood that the present invention is not limited thereto, but various modifications may be made without departing from the scope of the present invention.

The present disclosure relates to the subject matter contained in Japanese Patent Application No. 2004-167976, filed on Jun. 7, 2004, which is expressly incorporated herein by reference in its entirety.

What is claimed is:

1. A wet type image forming apparatus for forming an image with a developing solution containing toner in a carrier solution, comprising:

a developing solution carrier that holds the developing solution thereon, the developing solution carrier being electrically charged to attract toner contained in the developing solution toward its surface;

a photoconductive drum on which a latent image to be developed is formed, the photoconductive drum being arranged to contact the developing solution carrier;

a scraping blade disposed in contact with the developing solution carrier, the scraping blade scraping off the developing solution that has not been consumed for developing from the surface of the developing solution carrier; and a toner separator that separates the toner that has not been consumed for developing from the surface of the developing solution carrier before the developing solution is scraped off by the scraping blade.

2. The wet type image forming apparatus according to claim 1, wherein the toner separator separates the toner from the surface of the developing solution carrier utilizing an effect of electrophoresis.

3. The wet type image forming apparatus according to claim 2, wherein the toner separator generates an electric field so as to separate the toner in the developing solution from the surface of the developing solution carrier.

4. The wet type image forming apparatus according to claim 1, wherein the toner separator includes a conductive member, one end of the conductive member being electrically connected to the developing solution carrier and another end of the conductive member being electrically connected to a potential that is lower than a potential of the developing solution carrier in a charged state.

* * * * *